US008220430B2

(12) United States Patent
Gupta

(10) Patent No.: US 8,220,430 B2
(45) Date of Patent: Jul. 17, 2012

(54) INTAKE SYSTEM FOR INTERNAL COMBUSTION ENGINE

(75) Inventor: Nathan Gupta, Dearborn, MI (US)

(73) Assignee: Ford Global Technologies, Dearborn, MI (US)

( * ) Notice: Subject to any disclaimer, the term of this patent is extended or adjusted under 35 U.S.C. 154(b) by 662 days.

(21) Appl. No.: 12/470,555

(22) Filed: May 22, 2009

(65) Prior Publication Data

US 2010/0294226 A1 Nov. 25, 2010

(51) Int. Cl.
*F02M 35/10* (2006.01)
*F02F 1/42* (2006.01)

(52) U.S. Cl. ..... 123/184.21; 123/193.5

(58) Field of Classification Search ..... 123/184.21, 123/184.28, 184.38–184.52, 193.5
See application file for complete search history.

(56) References Cited

U.S. PATENT DOCUMENTS

| | | | |
|---|---|---|---|
| 4,180,041 | A | 12/1979 | Miyazaki et al. |
| 4,819,953 | A | 4/1989 | Joh |
| 5,107,804 | A | 4/1992 | Becker et al. |
| 5,145,190 | A | 9/1992 | Boardman |
| 5,267,543 | A | 12/1993 | Novak et al. |
| 5,280,769 | A | 1/1994 | Yates |
| 5,657,725 | A | 8/1997 | Butterfield et al. |
| 5,704,333 | A | 1/1998 | Okumura et al. |
| 5,957,464 | A | 9/1999 | Elliott |
| 6,055,806 | A | 5/2000 | Dalton |
| 6,311,986 | B1 | 11/2001 | Richardson et al. |
| 6,662,772 | B1 | 12/2003 | Murphy |
| 6,763,802 | B1 | 7/2004 | Brassell |
| 7,096,849 | B1 | 8/2006 | Mathis et al. |
| 7,337,758 | B2 | 3/2008 | Sturdy et al. |
| 2004/0134192 | A1 | 7/2004 | Umchara et al. |
| 2005/0179215 | A1 | 8/2005 | Kono |
| 2007/0017468 | A1 | 1/2007 | Letourneau et al. |
| 2008/0271697 | A1 | 11/2008 | Vichinsky |

FOREIGN PATENT DOCUMENTS

| | | | |
|---|---|---|---|
| JP | 2002106428 | A | 4/2002 |

*Primary Examiner* — Noah Kamen
(74) *Attorney, Agent, or Firm* — Jerome R. Drouillard; Julia Voutyras

(57) ABSTRACT

An intake system for an internal combustion engine includes a cylinder head and an intake manifold attached to the cylinder head. A labyrinth seal is interposed between the intake manifold and the cylinder head, with the labyrinth seal including a projection formed in one of the intake manifold and cylinder head, and a mating receptacle formed in the other of the intake manifold and a cylinder head.

14 Claims, 2 Drawing Sheets

INTAKE SYSTEM FOR INTERNAL COMBUSTION ENGINE

BACKGROUND OF THE INVENTION

1. Field of the Invention

The present invention relates to an intake manifold and cylinder head for an internal combustion engine, and more specifically to a sealing system for use between an intake manifold mounting flange and a cylinder head of the engine. The present invention is equally applicable for sealing an upper intake of an engine to a lower intake.

2. Related Art

Intake manifolds are typically mounted to the cylinder heads of internal combustion engines with detailed gasketing intended to prevent not only leaks of outside air into the engine's cylinders, but also to prevent pressure pulses in one intake runner from interacting with the pressure pulses in an adjacent intake runner. Although external leaks may adversely impact engine control because an external vacuum leak will likely cause unmetered air to be introduced into the engine's cylinders, thereby disturbing the air/fuel control, unwanted cross-talk between adjacent cylinder runners may very well upset the tuning of the engine, causing an undesirable decrement in power output. In most engines, the undesirable cross-talk between adjacent cylinder runners is prevented by causing the gasketing material provided between an intake manifold mounting flange and a cylinder head to extend between adjacent ones of the manifold runners. Unfortunately, this use of material merely for the purpose of preventing cross-talk between adjacent cylinders is costly and adds to the complexity of the gasket design. Moreover, this issue exists with other induction system joints, such as the joint between an upper intake manifold and a lower intake manifold.

It would be desirable to provide a sealing system between an intake manifold mounting flange and a cylinder head, or lower intake, which does not rely upon added gasketing material, but rather is incorporated into the basic design of the engine components themselves.

SUMMARY OF THE INVENTION

According to an aspect of the present invention, an intake system for an internal combustion engine includes a cylinder head and an intake manifold attached to the cylinder head. According to another aspect of the present invention, an intake manifold preferably comprises a one-piece plastic molding, including a plenum, a mounting flange, a number of intake runners extending between the plenum and the mounting flange, and a perimeter sealing region extending about only an outer periphery of the mounting flange. A labyrinth seal is interposed between the intake manifold and the cylinder head. According to another aspect of the present invention the labyrinth seal includes a projection formed in one of the intake manifold and the cylinder head, and a mating receptacle formed in the other of the intake manifold and cylinder head.

According to another aspect of the present invention, an intake manifold may include labyrinth seal segments configured as a number of projecting tongue elements mounted upon an intake manifold mounting flange through which a number of intake runners extend. The projecting tongue elements are mated with a number of grooved receptacle elements formed in either a cylinder head or a lower intake. Alternatively, according to another aspect of the present invention, a number of grooved receptacle elements may be molded within the intake manifold's mounting flange, with a number of mating projecting tongue elements being provided upon a cylinder head to which intake manifold is attached.

According to another aspect of the present invention, a labyrinth seal includes a projecting tongue formed upon an intake manifold mounting flange, with the tongue being formed from the parent material of the mounting flange. If the projecting tongue is formed upon the cylinder head, the tongue will preferably be formed from the parent metal of the cylinder head as one alternative.

It is an advantage of an intake system according to the present invention that the use of a perimeter gasket region extending about only an outer periphery of an intake manifold mounting flange allows the amount of gasket material used in an engine to be minimized, thereby reducing design complexity and material cost.

It is another advantage of an intake system according to the present invention that the present labyrinth seal is reusable, and need not be renewed if the intake manifold is removed from the engine and then subsequently reinstalled.

It is yet another advantage of an intake system according to the present invention that a complex computer simulation, correlated with engine dynamometer data, demonstrated that the present labyrinth seal will not cause a degradation in engine performance.

Other advantages, as well as features of the present invention, will become apparent to the reader of this specification.

DETAILED DESCRIPTION OF THE PREFERRED EMBODIMENTS

Figure 1:
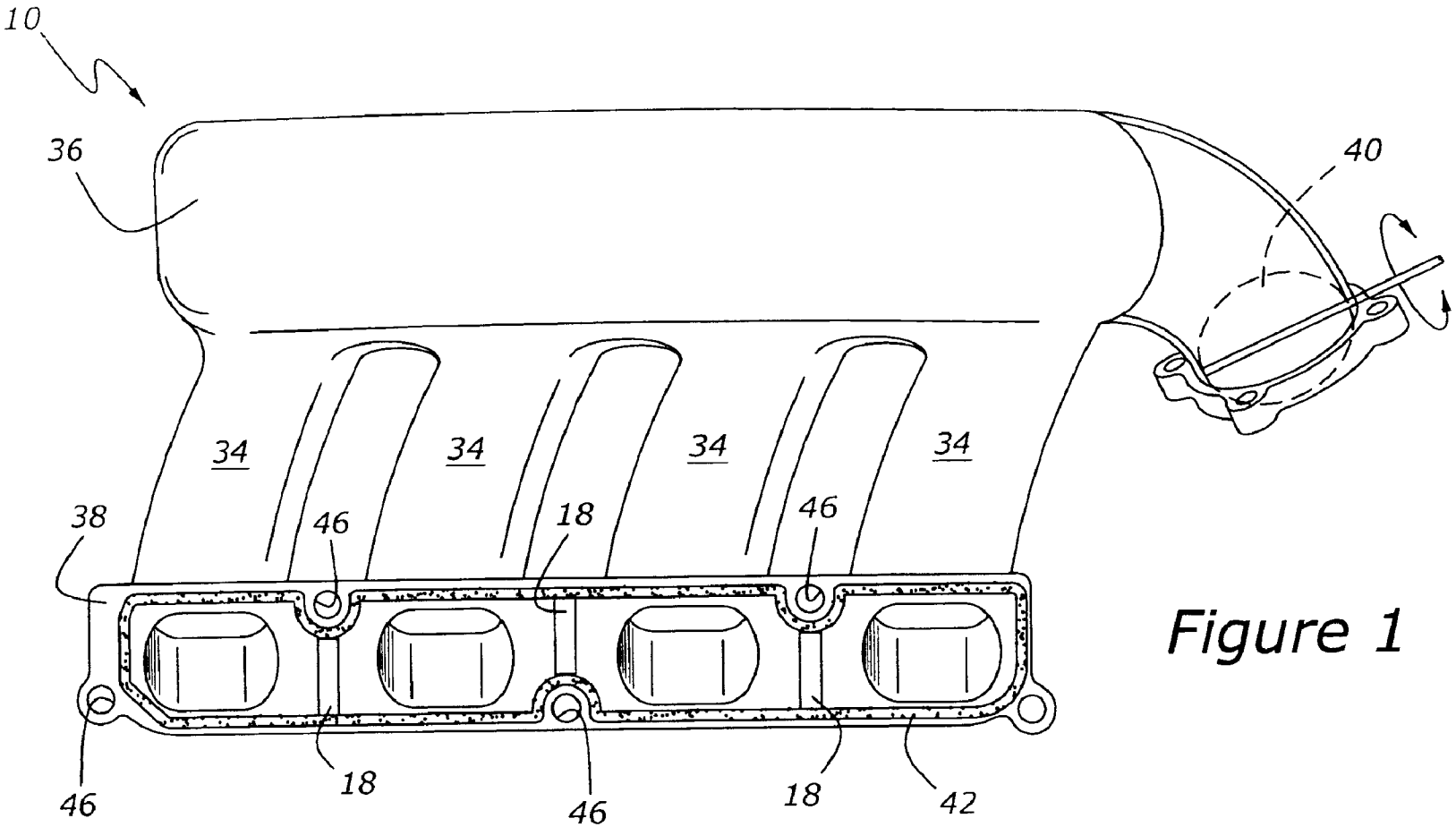
FIG. 1 is a perspective view of an intake manifold having a portion of a labyrinth seal system according to the present invention.

As shown in FIG. 1, intake manifold 10 includes a throttle valve, 40, leading to a plenum, 36, from which several runners, 34, extend to a mounting flange, 38. Intake manifold 10 may be configured as either an upper intake manifold which is used in conjunction with a lower intake manifold, or as a standalone intake manifold useable without the necessity of a lower intake manifold. Mounting flange 38 has a number of fastener apertures, 46, which allow the attachment of intake manifold 10 to a cylinder head of an engine. FIG. 1 also shows a perimeter gasket region, 42, which extends about the outer periphery of mounting flange 38. It is noted that perimeter gasket region 42 does not extend between adjacent runners 34 of intake manifold 10. Rather, FIG. 1 shows a first embodiment, in which a number of projecting tongue elements, 18, are molded upon mounting flange 38. These projecting tongue elements 18 cooperate with a number of grooved receptacle elements 26 formed in cylinder head 14 (FIG. 2), to prevent cross-talk between adjacent ones of intake runners 34. It is seen from FIG. 2 that, taken together, projecting tongue elements 18 and grooved receptacle elements 26 create a tortuous path between adjacent runners 34, so as to prevent pressure waves arising within adjacent intake runners 34 from interacting with one another.

Figure 2:
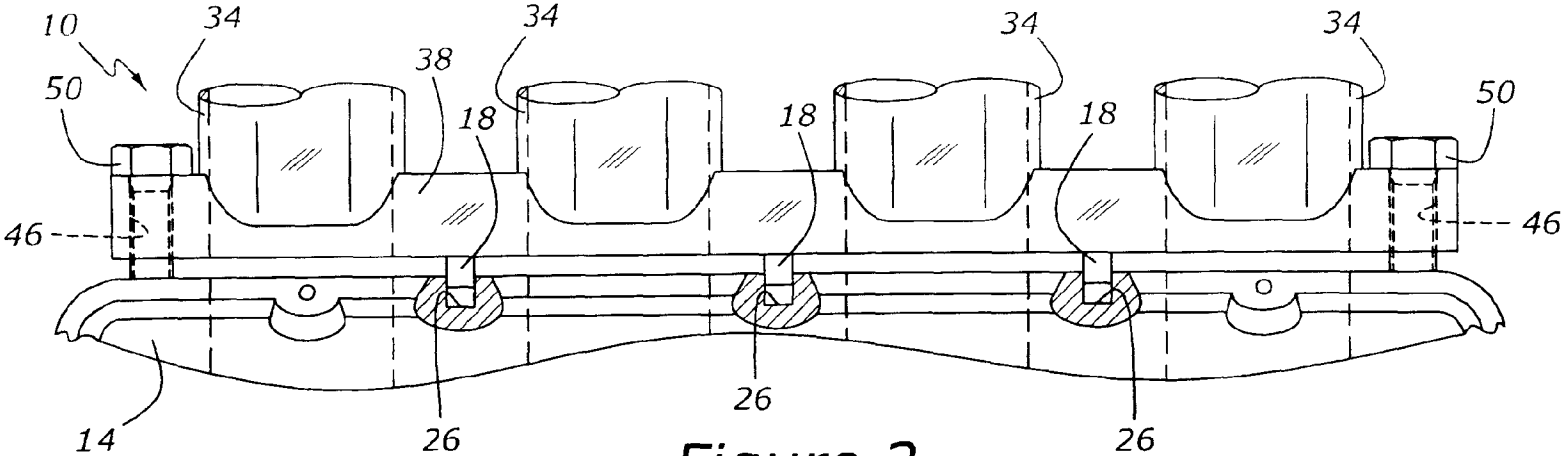
FIG. 2 is a partially schematic representation of an intake manifold and cylinder head utilizing a labyrinth seal according to the present invention.
Figure 3:
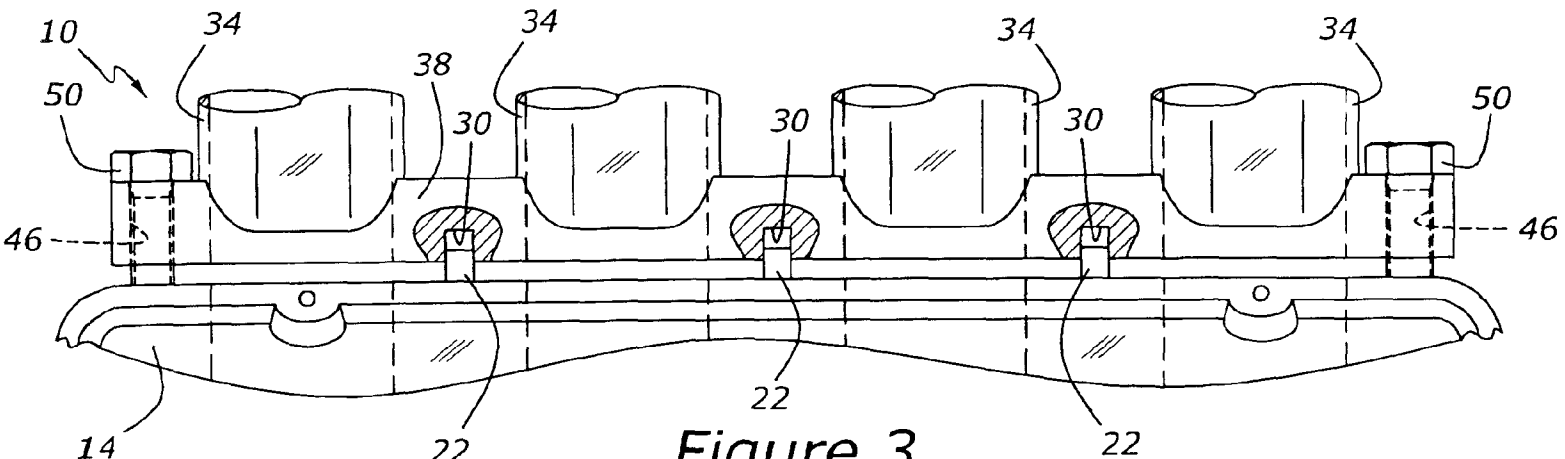
FIG. 3 is similar to FIG. 2, but shows a labyrinth seal in which projection and groove portions are reverse of those illustrated in FIG. 2.

The cylinder head 14 illustrated in FIGS. 2 and 3 may be either a cast, metallic cylinder head, or a plastic or metal lower intake manifold which is attached to a cylinder head casting and which functions as a portion of cylinder head 14. In other words, the present invention is useful with either the joint between an upper intake manifold and a lower intake manifold, or the joint between an intake manifold, whether it be an upper intake, or a lower intake, and a cylinder head.

FIG. 3 shows an embodiment in which cylinder head 14 is equipped with projecting tongue elements 22, with mounting flange 38 being provided with grooved receptacle elements 30. The embodiments of FIGS. 2 and 3 perform substantially in the same manner by preventing cross-talk between pressure waves within adjacent runners 34.

FIGS. 2 and 3 show that intake manifold 10 is attached to cylinder head 14 by threaded fasteners 50.

Projecting tongue elements 18 and 22 may advantageously be molded from the parent material of the component upon which they are placed. In the case of intake manifold 10, projecting tongues 18 could be formed as one piece with the parent material of mounting flange 38, which may be accomplished during molding, for example of intake manifold 10 from plastic material. Similarly, cylinder head 14 may be advantageously molded from metals such as aluminum, iron or other materials, with projecting tongues 22 being produced during the molding process. If the portion of cylinder head 14 illustrated in FIGS. 2 and 3 is configured as a lower intake, tongues 22 may be formed from the parent plastic or metal from which the lower intake is fabricated. In any event, projecting tongues 18, are preferably sized to fit snugly within mating grooved receptacles 26, as shown in FIG. 2, thereby reducing cross-talk between adjacent manifold runners, effectively without the need for any additional gasketing material.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An intake system for an internal combustion engine, comprising:
- a cylinder head;
- an intake manifold attached to said cylinder head; and
- a labyrinth seal interposed between said intake manifold and said cylinder head, wherein said labyrinth seal comprises a projection formed in one of said intake manifold and said cylinder head, and a mating receptacle formed in the other of said intake manifold and said cylinder head.

2. An intake system according to claim 1, wherein said labyrinth seal extends only between adjacent runners of said intake manifold.

3. An intake system according to claim 1, wherein said intake manifold comprises a plurality of intake runners extending to a common mounting flange, with said mounting flange having a perimeter sealing region extending about only an outer periphery of the mounting flange.

4. An intake system according to claim 1, wherein said labyrinth seal comprises a plurality of projecting tongue elements molded upon a mounting flange through which a plurality of intake runners extend, and a plurality of mating grooved receptacle elements formed in said cylinder head.

5. An intake system according to claim 4, wherein said tongue elements are molded as one-piece with the parent material of said mounting flange.

6. An intake system according to claim 1, wherein said labyrinth seal comprises a plurality of grooved receptacle elements molded within a mounting flange through which a plurality of intake runners extend, and a plurality of mating projecting tongue elements formed upon said cylinder head.

7. An intake system according to claim 6, wherein said tongue elements are molded from the parent material of said cylinder head.

8. An intake system according to claim 1, wherein said intake manifold comprises a one-piece plastic molding comprising:
- a plenum;
- a mounting flange;
- a plurality of intake runners extending between said plenum and said mounting flange;
- a perimeter gasket region extending about only an outer periphery of the mounting flange; and
- a portion of said labyrinth seal extending transversely across said mounting flange between adjacent ones of said intake runners.

9. An intake system according to claim 8, wherein said portion of said labyrinth seal comprises a projecting tongue formed upon said mounting flange, with said tongue being formed from the parent material of said mounting flange.

10. An intake system according to claim 8, wherein said portion of said labyrinth seal comprises a grooved receptacle formed upon said mounting flange.

11. An intake system according to claim 1, wherein said cylinder head comprises a lower intake manifold and said intake manifold comprises an upper intake manifold joined to said lower intake manifold.

12. An intake system for an internal combustion engine, comprising:
- a cylinder head;
- an intake manifold attached to said cylinder head, with said intake manifold comprising:
- a plenum;
- a mounting flange;
- a plurality of intake runners extending between said plenum and said mounting flange;
- a perimeter gasket region extending about only an outer periphery of the mounting flange; and
- a labyrinth seal interposed between said mounting flange of said intake manifold and said cylinder head and located between adjacent ones of said intake runners, wherein said labyrinth seal comprises a tongue formed in one of said intake manifold and said cylinder head, and a mating groove formed in the other of said intake manifold and said cylinder head.

13. An intake system according to claim 12, wherein said intake manifold comprises at least one plastic molding including said tongue.

14. An intake system for an internal combustion engine, comprising:
- a cylinder head having a lower intake manifold attached thereto;
- an intake manifold attached to said lower intake manifold, with said intake manifold comprising:
- a plenum;
- a mounting flange;
- a plurality of intake runners extending between said plenum and said mounting flange;
- a perimeter gasket region extending about only an outer periphery of the mounting flange; and a labyrinth seal interposed between said mounting flange of said intake manifold and said lower intake manifold and located between adjacent ones of said intake runners, wherein said labyrinth seal comprises a tongue formed in one of said intake manifold and said lower intake manifold, and a mating groove formed in the other of said intake manifold and said lower intake manifold.

* * * * *